US010531771B2

(12) United States Patent
Thorne

(10) Patent No.: US 10,531,771 B2
(45) Date of Patent: Jan. 14, 2020

(54) SURFACE CLEANING APPARATUS WITH CORDLESS CONVERTIBLE HANDHELD CONFIGURATION

(71) Applicant: SHARKNINJA OPERATING LLC, Newton, MA (US)

(72) Inventor: Jason B. Thorne, Wellesley Hills, MA (US)

(73) Assignee: SharkNinja Operating LLC, Needham, MA (US)

( * ) Notice: Subject to any disclaimer, the term of this patent is extended or adjusted under 35 U.S.C. 154(b) by 227 days.

(21) Appl. No.: 15/671,717

(22) Filed: Aug. 8, 2017

(65) Prior Publication Data

US 2018/0035854 A1 Feb. 8, 2018

Related U.S. Application Data

(60) Provisional application No. 62/371,916, filed on Aug. 8, 2016.

(51) Int. Cl.

| | |
|---|---|
| ***A47L 5/22*** | (2006.01) |
| ***A47L 9/00*** | (2006.01) |
| ***A47L 9/04*** | (2006.01) |
| ***A47L 9/28*** | (2006.01) |

(52) U.S. Cl.

CPC ..... *A47L 5/225* (2013.01); *A47L 9/0018* (2013.01); *A47L 9/0477* (2013.01); *A47L 9/2884* (2013.01)

(58) Field of Classification Search

CPC ..... A47L 5/225; A47L 9/0018; A47L 9/0477; A47L 9/2884

See application file for complete search history.

(56) References Cited

U.S. PATENT DOCUMENTS

| | | | | |
|---|---|---|---|---|
| 9,155,431 | B2 * | 10/2015 | Dyson | A47L 5/24 |
| 2005/0058893 | A1 * | 3/2005 | O'Neal | H01M 2/1022 429/123 |
| 2010/0239903 | A1 * | 9/2010 | Churchill | H01M 2/1022 429/178 |
| 2015/0155606 | A1 * | 6/2015 | Stickney | A47L 9/2884 429/90 |
| 2015/0297050 | A1 * | 10/2015 | Marsh | A47L 9/242 15/344 |
| 2015/0320474 | A1 * | 11/2015 | Bennett | A61B 17/32002 606/34 |
| 2016/0198914 | A1 * | 7/2016 | Conrad | A47L 9/2868 15/329 |
| 2017/0007085 | A1 * | 1/2017 | Tahara | A47L 5/36 |
| 2017/0265696 | A1 * | 9/2017 | Conrad | A47L 5/28 |

(Continued)

FOREIGN PATENT DOCUMENTS

WO WO-2014174248 A1 * 10/2014 ..... A47L 5/225

*Primary Examiner* — Marc Carlson

(74) *Attorney, Agent, or Firm* — Grossman Tucker Perreault & Pfleger, PLLC

(57) ABSTRACT

In an embodiment, a surface cleaning apparatus is disclosed. The surface cleaning apparatus including a surface cleaning head, a handheld unit, at least one tube configured to be removably coupled between the handheld unit and the surface cleaning head such that an air flow path is formed from the surface cleaning head through the tube to the handheld unit, and a battery pack electrically connected to the handheld unit and configured to be removably mounted to the surface cleaning head, to the tube, and/or to the handheld unit.

20 Claims, 1 Drawing Sheet

FIG. 1B

(56) References Cited

U.S. PATENT DOCUMENTS

| | | | | |
|---|---|---|---|---|
| 2017/0280951 | A1* | 10/2017 | Nam | A47L 9/1616 |
| 2018/0000303 | A1* | 1/2018 | Conrad | A47L 5/225 |
| 2018/0055315 | A1* | 3/2018 | Conrad | A47L 5/225 |

* cited by examiner

SURFACE CLEANING APPARATUS WITH CORDLESS CONVERTIBLE HANDHELD CONFIGURATION

CROSS-REFERENCE TO RELATED APPLICATIONS

This application claims the benefit of co-pending U.S. Provisional Patent Application Ser. No. 62/371,916, filed on Aug. 8, 2016, which is fully incorporated herein by reference.

TECHNICAL FIELD

The present disclosure relates to surface cleaning devices and more particularly, to a cordless convertible handheld/stick vacuum.

BACKGROUND INFORMATION

Existing handheld/stick vacuums may be used as either an upright stick vacuum or a handheld vacuum. One example of such a vacuum is the SHARK® ROCKET® HV320 Series available from SharkNinja Operating LLC. These vacuums are generally designed to be light-weight and versatile. Providing a cordless version of such vacuums presents a challenge because the addition of a battery pack adds mass to the vacuum and may adversely affect the versatility.

BRIEF DESCRIPTION OF THE DRAWINGS

These and other features and advantages will be better understood by reading the following detailed description, taken together with the drawings wherein.

DETAILED DESCRIPTION

Figures 1A, 1B, 1C:
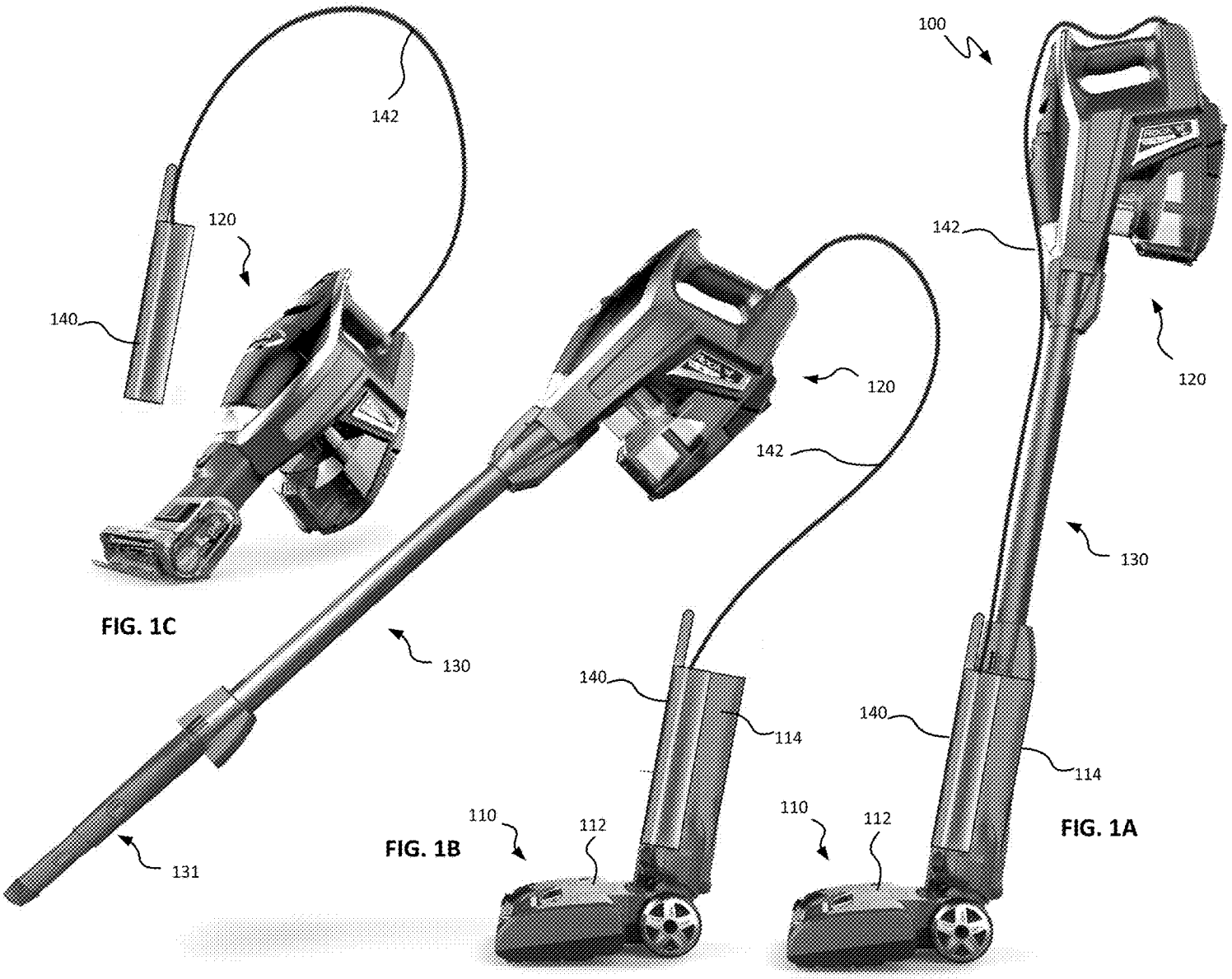
FIG. 1A is a side perspective view of a cordless handheld and upright vacuum, consistent with an embodiment of the present disclosure.
FIG. 1B is a side perspective view of a cordless handheld and upright vacuum with the handheld unit removed from the surface cleaning head, consistent with an embodiment of the present disclosure.
FIG. 1C is a side perspective view of a cordless handheld and upright vacuum with the handheld unit and the batter pack removed from the surface cleaning head, consistent with an embodiment of the present disclosure.

Referring to FIGS. 1A-1C, a cordless convertible handheld stick vacuum 100 is capable of being used as a stick vacuum (FIG. 1A) or as a handheld vacuum (FIGS. 1B and 1C). As used herein, "cordless" means capable of being operated under battery power and without requiring a cord to connect the device to an external power source (e.g., AC power). Although the vacuum describe herein may be cordless, a cord may be used to connect the battery to an external power source for charging the battery and/or for connecting the battery to powered components in the vacuum.

The cordless convertible handheld/stick vacuum 100 generally includes a surface cleaning head 110, a handheld unit 120, and one or more tubes 130 coupled between the surface cleaning head 110 and the handheld unit 120. The handheld unit 120 and the tubes 130 may be referred to as a cleaning wand or simply a wand. The cordless convertible handheld stick vacuum 100 further includes a battery pack 140 electrically connected to the handheld unit 120 and removably mounted on the surface cleaning head 110, the handheld unit 120, and/or the tube(s) 130. In the illustrated embodiment, the battery pack 140 is electrically connected to the handheld unit 120 using a battery cable 142, such as a thin flexible cable. The battery pack 140 may include an 18v NiMH battery, although other types of batteries may be used. By providing the battery pack 140 separate from the handheld unit 120, the size and weight of the handheld unit 120 may be kept to a minimum without sacrificing the versatility of the vacuum.

The handheld unit 120 and tube(s) 130 may be generally referred to as in a "docked" position when coupled into the nozzle 114 as shown in FIG. 1A. The docked position may allow the battery pack 140 to charge when, for instance, the cordless convertible hand-held/stick vacuum 100 is coupled to a power outlet via a cord. The docked position may further include at least a portion 131 (FIG. 1B) of the tube(s) 130 extending into the nozzle 114. This may reduce the overall height of the cordless convertible handheld/stick vacuum 100.

In one embodiment, the cordless convertible handheld/stick vacuum 100 may be based on an existing handheld/stick vacuum product such as the SHARK® ROCKET® HV320 Series available from SharkNinja Operating LLC. The surface cleaning head 110 may include, for example, a rotatable driven brush roll and a drive mechanism for driving the brush roll. The drive mechanism may be electrically connected to the handheld unit 120 when the handheld unit 120 is coupled to the surface cleaning head 110 either directly or through the tube(s) 130. The handheld unit 120 may include an air transportation and treatment system for transporting and treating air moving along a flow path through the surface cleaning head 110 and the tube(s) 130. Although one embodiment of the handheld/stick vacuum is shown and disclosed, a battery pack, as described herein, may be used with other types of handheld/stick vacuums such that the battery pack is electrically connected and tethered to a handheld unit and configured to be removably mounted to a surface cleaning head.

In the illustrated embodiment, the surface cleaning head 110 includes a surface cleaning head housing 112 and a nozzle 114 extending from the housing 112. The tube(s) 130 may be coupled between the nozzle 114 and the handheld unit 120 or the handheld unit 120 may be coupled directly to the nozzle 114 without the tubes (not shown). In this embodiment, the battery pack 140 is removably mounted to the nozzle 130 and may remain mounted to the nozzle 130 when used as a stick vacuum (FIG. 1A) or when used as a handheld vacuum (FIG. 1B). The battery pack 140 may be removably mounted, for example, using releasable latching mechanisms or other structures configured to receive and secure the battery pack.

In other embodiments, the battery pack 140 may be mounted in other locations on the surface cleaning head 110. The battery pack 140 may also be mounted on the tube(s) 130 or on the handheld unit 120. The battery pack 140 may also be removed to facilitate use of the handheld unit 120 as a handheld vacuum (FIG. 1C). The battery pack 140 may be held in the user's hand or clipped to the user's belt or other location. The battery pack 140 may include, for example, a clip to allow the battery pack to be secured to a user, for example, on a belt worn by the user. The handheld unit 120 may also include an attachment mechanism (e.g., on the bottom, the side, or the back) for attaching the battery pack 140 to the handheld unit 120. The attachment mechanism may include, for example, a slot and/or clips configured to receive and secure the battery pack 140. Having the battery pack 140 electrically connected and tethered to the handheld unit 120 with the battery cable 142 provides versatility by allowing the user to mount the battery pack 140 in different locations based on the user's preference.

When assembled as a stick vacuum, as shown in FIG. 1A, the battery cable 142 may run along the tube(s) 130 and the handheld unit 120. For example, the battery cable 142 may run along external surfaces of the tube(s) 130 and the handheld unit 120 to reduce the risk of the battery cable 142 snagging on objects an in environment. Alternatively, or in addition, electrical connections between the battery pack 140 and the handheld unit 120 can be integrated internally, e.g., via one or more wires, extending through the tube(s) 130 and/or the nozzle 114 depending on the specific location of the battery pack 140.

The vacuum 100 may include one or more structures or mechanisms for securing and/or managing the battery cable 142, for example, on the surface cleaning head 110, the handheld unit 120, and/or the tube(s) 130. The structures may include clips (e.g., along the tube(s) 130 and/or handheld unit 120), channels, or any other structure/feature for receiving and holding the battery cable 142.

When used as a handheld vacuum, as shown in FIGS. 1B and 1C, some or all of the battery cable 142 may be wound or coiled as needed to prevent interference with the user (not shown). The handheld unit 120 may include, for example, a structure for coiling or winding the battery cable 142 and/or a winding mechanism for automatically retracting the battery cable 142. When the battery pack 140 is mounted to the handheld unit 120, for example, the battery cable 142 may be retracted to prevent interference with use.

In some cases, the battery pack 140 may be removable to allow for spares/replacements to be easily attached and extend the operational time of the cordless convertible handheld stick vacuum 100. As shown in FIGS. 1A/1B, the battery pack 140 may include a hosing that extend substantially in parallel with a longitudinal axis of the tube(s) 130 and/or the handheld unit 120. This may advantageously reduce the overall footprint of the cordless convertible handheld stick vacuum 100.

Accordingly, a cordless convertible handheld/stick vacuum provides the versatility and light weight of a vacuum that can be converted from a stick vacuum to a handheld vacuum while allowing a cordless operation.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. A surface cleaning apparatus comprising:
- a surface cleaning head;
- a handheld unit;
- at least one tube configured to be removably coupled between the handheld unit and the surface cleaning head such that an air flow path is formed from the surface cleaning head through the at least one tube to the handheld unit; and
- a battery pack electrically connected to the handheld unit and configured to be removably mounted to the surface cleaning head, the battery pack configured to remain mounted to the surface cleaning head when the handheld unit is decoupled from the surface cleaning head during use as a handheld vacuum.

2. The surface cleaning apparatus of claim 1 wherein the surface cleaning head includes a surface cleaning head housing and a nozzle extending from the surface cleaning head housing, wherein the nozzle is configured to be removably coupled to the at least one tube.

3. The surface cleaning apparatus of claim 1 wherein the battery pack is electrically connected to the handheld unit with a battery cable.

4. The surface cleaning apparatus of claim 3 wherein the handheld unit includes a structure for winding the battery cable.

5. The surface cleaning apparatus of claim 3 wherein the handheld unit includes a winding mechanism for automatically retracting and winding the battery cable.

6. The surface cleaning apparatus of claim 3 further including at least one structure for retaining the battery cable.

7. The surface cleaning apparatus of claim 6 wherein the structure is located on the tube.

8. The surface cleaning apparatus of claim 6 wherein the structure is located on the handheld unit.

9. The surface cleaning apparatus of claim 1 wherein the handheld unit includes an air transportation and treatment system for transporting and treating air moving along the air flow path.

10. The surface cleaning apparatus of claim 1 wherein the surface cleaning head includes a rotatable driven brush roll and a drive mechanism, and wherein the drive mechanism is electrically connected to the handheld unit.

11. The surface cleaning apparatus of claim 1 wherein the battery pack includes a clip for securing the battery pack on a user.

12. The surface cleaning apparatus of claim 1 wherein the handheld unit includes at least one attachment mechanism for removably mounting the battery pack.

13. The surface cleaning apparatus of claim 1 wherein the handheld unit is configured to be coupled directly to the surface cleaning head without the tube.

14. A surface cleaning apparatus comprising:
- a surface cleaning head;
- a handheld unit configured to be removably coupled to the surface cleaning head; and
- a battery pack electrically connected to the handheld unit with a battery cable, the battery pack being configured to be removably mounted to a location on the surface cleaning head and a location on the handheld unit.

15. The surface cleaning apparatus of claim 14 further including at least one tube configured to be removably coupled between the surface cleaning head and the handheld unit.

16. The surface cleaning apparatus of claim 14 implemented as a cordless convertible handheld stick vacuum.

17. The surface cleaning apparatus of claim 14 wherein the battery pack includes a clip to attach to a user.

18. The surface cleaning apparatus of claim 14, wherein the handheld unit includes a structure for automatically winding the battery cable.

19. A surface cleaning apparatus, the surface cleaning apparatus comprising:
- a surface cleaning head having a nozzle;
- a handheld unit for removably coupling with the nozzle;
- a battery pack for removably mounting to the surface cleaning head and/or handheld unit;
- a battery cable to electrically connect and tether to the handheld unit to the battery pack such that the battery pack remains electrically connected by the battery cable when the battery pack is decoupled from the handheld unit.

20. The surface cleaning apparatus of claim 19, further comprising at least one tube configured to be removably coupled between the handheld unit and the surface cleaning head such that an air flow path is formed from the surface cleaning head through the at least one tube to the handheld unit, and wherein the battery cable extends externally to the handheld unit.

* * * * *